US006499993B2

(12) United States Patent
Steber et al.

(10) Patent No.: US 6,499,993 B2
(45) Date of Patent: Dec. 31, 2002

(54) EXTERNAL DILUTION AIR TUNING FOR DRY LOW NOX COMBUSTORS AND METHODS THEREFOR

(75) Inventors: Charles Evan Steber, Alpharetta, GA (US); Larry Lou Thomas, Flat Rock, NC (US); Mark William Pinson, Greer; Ronald Thomas Clawson, Simpsonville, both of SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/748,679

(22) Filed: Dec. 22, 2000

(65) Prior Publication Data

US 2001/0046651 A1 Nov. 29, 2001

Related U.S. Application Data

(63) Continuation-in-part of application No. 09/578,663, filed on May 25, 2000, now Pat. No. 6,331,110.

(51) Int. Cl.[7] ..... F23R 32/60

(52) U.S. Cl. ..... 431/352; 431/154; 431/351; 431/353; 431/190; 431/10; 60/759; 60/39.23; 60/39.32; 60/755

(58) Field of Search ..... 431/154, 351, 431/352, 353; 60/755–760, 39.23, 23.32; 285/201–203

(56) References Cited

U.S. PATENT DOCUMENTS

| | | | | | |
|---|---|---|---|---|---|
| 3,927,520 | A | | 12/1975 | Arvin et al. | |
| 3,930,368 | A | * | 1/1976 | Anderson et al. | 60/39.23 |
| 4,050,240 | A | * | 9/1977 | Vaught | 60/39.65 |
| 4,054,028 | A | * | 10/1977 | Kawaguchi | 60/39.23 |
| 4,267,698 | A | * | 5/1981 | Hartmann et al. | 60/756 |
| 4,301,657 | A | | 11/1981 | Penny | |
| 4,389,848 | A | | 6/1983 | Markowski et al. | |
| 4,653,279 | A | * | 3/1987 | Reynolds | 60/757 |
| 4,805,397 | A | * | 2/1989 | Barbier et al. | 60/39.32 |
| 4,875,339 | A | * | 10/1989 | Rasmussen et al. | 60/757 |
| 5,240,404 | A | | 1/1993 | Hemsath et al. | |
| 5,235,805 | A | | 8/1993 | Barbier et al. | |
| 5,454,211 | A | * | 10/1995 | Loprinzo | 60/39.06 |
| 5,454,221 | A | | 10/1995 | Loprinzo | |
| 5,581,999 | A | * | 12/1996 | Johnson | 60/756 |
| 5,636,510 | A | * | 6/1997 | Beer et al. | 60/39.23 |
| 5,664,412 | A | | 9/1997 | Overton | |
| 5,916,142 | A | * | 6/1999 | Snyder et al. | 60/748 |
| 6,351,949 | B1 | * | 3/2002 | Rice et al. | 403/316 |

FOREIGN PATENT DOCUMENTS

| | | |
|---|---|---|
| GB | 985058 | 3/1965 |
| GB | 2003989 | 3/1979 |

* cited by examiner

*Primary Examiner*—Henry Bennett
*Assistant Examiner*—Kathryn Ferko
(74) *Attorney, Agent, or Firm*—Banner & Witcoff, Ltd.

(57) ABSTRACT

A combustor having a combustion liner and at least one combustor orifice assembly, the combustor orifice assembly comprising a boss, an orifice plate that defines an orifice, the orifice plate having a bottom surface that is adapted to be received by the boss, and a retaining ring, whereby the orifice plate is retained between the retaining ring and the boss.

28 Claims, 8 Drawing Sheets

112
80
84
86
82
180°
88
98
74
80

112
80
84
86
160°
82
88
100
74
80

EXTERNAL DILUTION AIR TUNING FOR DRY LOW NOX COMBUSTORS AND METHODS THEREFOR

CROSS REFERENCE TO RELATED APPLICATION

This application is a continuation-in-part application of U.S. Ser. No. 09/578,663, filed May 25, 2000, now U.S. Pat. No. 6,331,110.

BACKGROUND OF THE INVENTION

The present invention relates to apparatus and methods for adjusting the NOX level of emissions of heavy-duty gas turbines for emissions compliance without disassembly of the combustors and particularly relates to a mechanical arrangement enabling external access to the dilution air sleeves for the combustion chamber for adjusting the combustor dilution air flow hole areas and methods of adjustment.

Heavy-duty gas turbines employing dry low NOX, combustion systems are typically installed with predetermined dilution flow hole areas for flowing compressor discharge air into the combustion liner to shape the gas temperature profile exiting the combustion system and provide reduced NOX emissions. Dilution air flow sleeves are typically provided and have a predetermined hole area for flowing compressor discharge air into the combustion liner. Not infrequently, however, and after installation of the turbine at the power generation site, the NOX emissions level is either too high or too low, with corresponding CO emissions level that is too high. This is a result of the normal variability of machine air flow fraction that is delivered to the combustor and the resulting variability of flame temperature in the NOX, producing zones of the combustor.

Under those circumstances, the turbine is typically brought into NOX emissions compliance by removal of the combustion liners from the turbine and resizing the dilution holes to redistribute the combustor air flow. This procedure requires the physical removal of the combustion liner from the turbine with attendant removal of certain piping for fuel, as well as piping for oil and water systems and auxiliary air piping for atomization. It is also necessary to remove the heavy end cover of the combustor to gain access to the dilution holes. Further, there is the possibility of contaminating the fuel system in the process of removing and reassembling the various piping systems. The combustion liners are then sent to a service shop to have the existing dilution holes resized. Still further, this process can take between one to two weeks time, during which there is a gas turbine outage, preventing the electricity provider from producing power during that period of time. Consequently, there is a need for a system that facilitates change of the combustor dilution hole areas without disassembly and subsequent reassembly of major portions of the combustor and in a reduced timeframe.

BRIEF SUMMARY OF THE INVENTION

In accordance with an embodiment of the present invention, there is provided a mechanical arrangement enabling external access to the combustion chamber which facilitates changeover of combustor dilution hole areas to adjust the NOX levels without disassembly of the combustors. To accomplish this, the combustion liner and surrounding air flow sleeve have aligned radial openings at an axial location along the liner for admitting dilution air through dilution sleeves in the aligned radial openings into the combustion chamber. An outer casing surrounds the flow sleeve and defines with the flow sleeve an annular flow passage for flowing compressor discharge air through the dilution sleeves into the combustion chamber. The openings through the flow sleeve are provided with collars which form seats for receiving flanges of the dilution sleeves. The outer casing is also provided with a cylindrical boss or flange in line with the axes of the openings through the combustion liner and flow sleeve, affording access to the dilution sleeves externally of the combustor. A cover is releasably secured to the cylindrical flange, for example, by bolts, and a spring cooperates between the cover and the flange on each dilution sleeve to maintain the dilution sleeve in the aligned openings of the combustion liner and flow sleeve with the flange of the dilution sleeve seated on the collar.

Each dilution sleeve has a central opening of a predetermined area. In the event that the NOX emissions are out of compliance after initial installation of the gas turbine, the access covers to the installed dilution sleeves are removed and dilution sleeves having holes of different areas are inserted to provide more or less compressor discharge air flow through the sleeves into the combustion chamber. Particularly, after the NOX emissions of the newly installed turbine have been measured at the design operating conditions, the actual measured NOX emission level is compared with the required NOX emission level for compliance. If the measured NOX emissions deviate to the extent the turbine is out of compliance, an increase or decrease in the hole area of the installed dilution sleeves is calculated to arrive at a dilution hole area effective to provide a NOX emission level within the compliance range. Once the required dilution hole area is determined, the combustion covers are removed and a new set of dilution sleeves conforming to the new required hole area is provided. Alternatively, the initially installed set of dilution sleeves are machined to the required new dilution hole areas. In either case, the dilution sleeves with the required hole areas are inserted through the cylindrical bosses to seat on the collars about the openings in the flow sleeve and extend through the aligned openings through the flow sleeve and the combustion liner. The springs and covers are then reinstalled to secure the dilution sleeves in place with the properly sized dilution hole areas.

In an embodiment according to the present invention, there is provided a combustor for a gas turbine comprising an outer casing, a flow sleeve within the outer casing defining an air flow passage with the outer casing, a combustion liner within the flow sleeve for flowing hot gases of combustion, at least one opening in each combustion liner and the flow sleeve, a dilution sleeve removably received within the openings of the combustion liner and the flow sleeve and an access port in the outer casing for access to the dilution sleeve, the dilution sleeve being sized for passage through the access port enabling insertion into or removal of the dilution sleeve from the openings.

In a further embodiment according to the present invention, there is provided in a combustor for a gas turbine having a combustion liner defining a hot gas flow path, an outer casing, a flow sleeve between the outer casing and the liner defining a dilution air flow path therebetween, and openings through the flow sleeve and the liner for flowing dilution air in the dilution air flow path into the hot gas flow path, a method of adjusting the level of NOX emissions comprising the steps of (a) providing a dilution air flow sleeve in the openings having an air flow passage of a predetermined area, (b) measuring the NOX emissions from the gas turbine at design operating conditions, (c) determining a deviation of the measured NOX emissions from a predetermined desired level of NOX emissions, (d) ascertaining a predetermined area of a desired air flow passage through an air flow dilution sleeve based on the deviation, and (e) installing an air flow dilution sleeve in the turbine having a flow area sized to provide at least approximately the desired level of NOX emissions.

An alternative embodiment of the present invention comprises a combustor air tuning liner design having combustor orifice assembly comprising a boss, an orifice plate, and a retaining ring. This embodiment provides an alternative construction for the retuning of a combustor by allowing for the replacement of incorrectly sized orifices with correctly sized orifices, all without having to send the combustion liner to a service shop. Thus, the alternative embodiment of the present invention reduces the time and money needed retune combustors to achieve a desired level of NOX emissions.

Further, since the only part that is replaced is the orifice plate, the present invention provides for easy and efficient retuning than a retune that requires service shop work on the combustion liner. This alternative embodiment can be used to retune a combustor prior to or after the combustor is placed into service so that it meets emission requirements.

The present invention eliminates service shop time and cost, and at the same time provides operator friendly dilution hole change capability. Further, the present invention provides proper cooling for successful operation in a harsh thermal environment where the liner skin reaches about greater than 1400 degrees Fahrenheit. In addition, the present invention provides a simple, reliable, and structurally sound design.

DETAILED DESCRIPTION OF THE INVENTION

Figure 1:
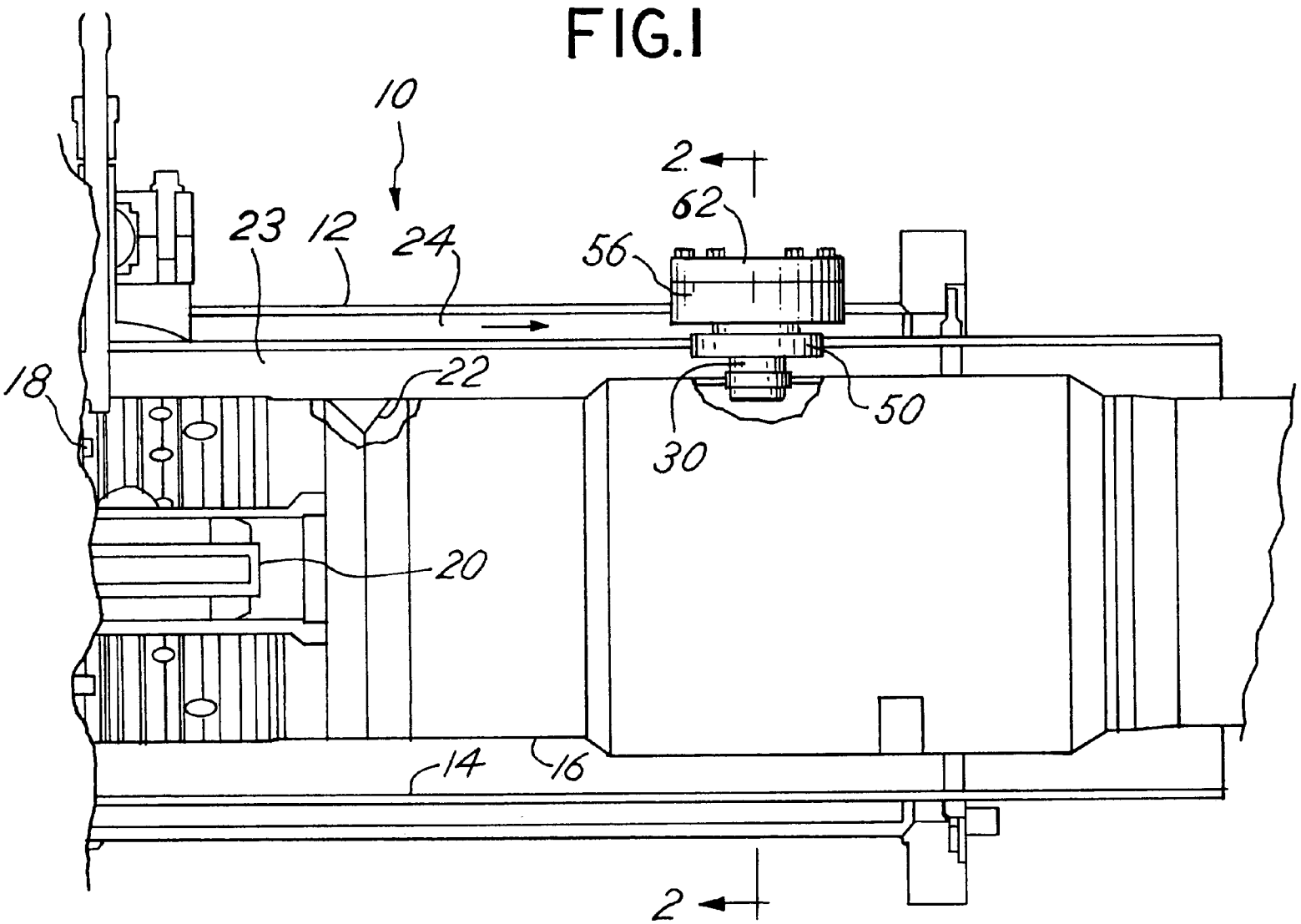
FIG. 1 is a fragmentary cross-sectional view of a combustor for a gas turbine illustrating a dilution sleeve for flowing dilution air into the combustion chamber constructed in accordance with an embodiment of the present invention.
Figure 2:
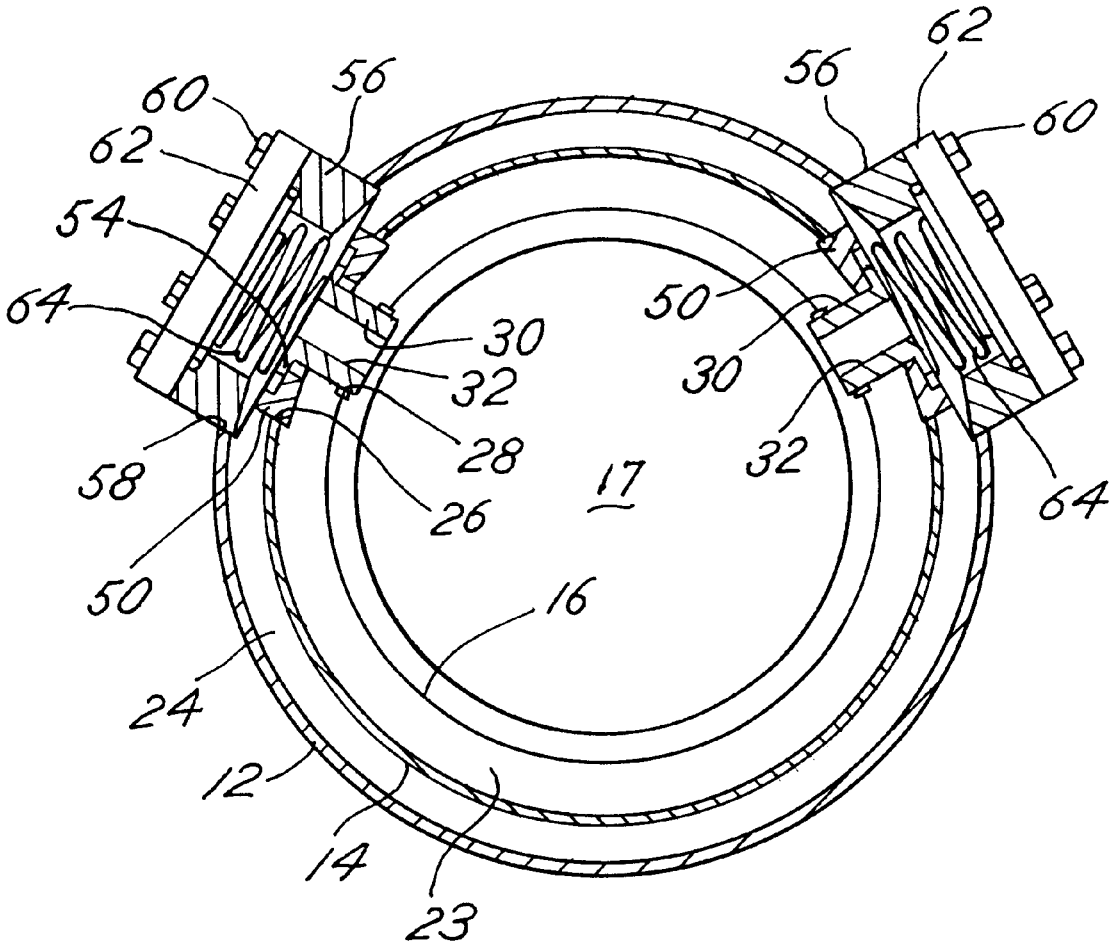
FIG. 2 is a cross-sectional view thereof taken generally about on line 2—2 in FIG. 1.

Referring now to the drawings, particularly to FIG. 1, there is illustrated a dry low NOX combustor, generally designated 10, comprised of a combustor outer casing 12, a flow sleeve 14, generally concentrically within the outer casing 12, and a flow liner 16 for confining the hot gases of combustion in a hot gas flow path 17 (FIG. 2). Additionally illustrated are primary and secondary fuel nozzles 18 and 20, respectively, and a venturi 22. It will be appreciated that fuel is supplied to the nozzles 18 or 20 and the hot gases of combustion are generated for flow generally axially downstream within the combustion liner 16 and into the first stage of a gas turbine, not shown. As conventional, cooling air is supplied along an annular passage 23 between the combustion liner 16 and flow sleeve 14 for flow into the reaction chamber. A proportion of compressor discharge air also flows in the annular passage 24 between the outer casing 12 and the flow sleeve 14 in the direction of the arrow for supplying dilution air into the reaction chamber.

Figures 4A, 4B, 4C:
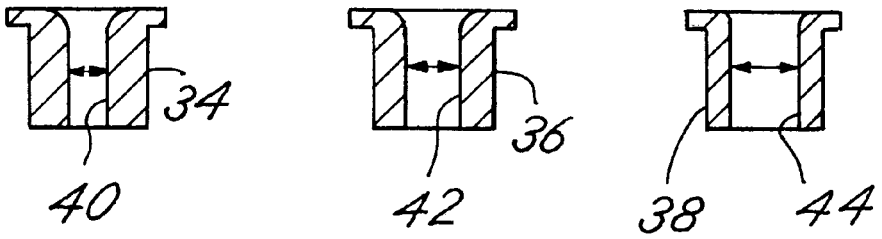
FIGS. 4A, 4B and 4C illustrate a set of dilution sleeves of identical outside diameters and with different inside diameters affording different dilution sleeve flow areas.

Referring to FIG. 2, the dilution air is provided through openings 26 and 28 in the flow sleeve 14 and combustion liner 16, respectively. In FIG. 2, two sets of openings 26 and 28 are radially aligned at circumferentially spaced positions about the combustor for receiving the compressor discharge dilution air in annular passage 24. Dilution flow sleeves 30 extend through the aligned openings 26 and 28 for directing the dilution air into the combustion chamber, the dilution sleeves 30 having central openings 32 of predetermined flow areas. By changing the flow areas of the dilution sleeves 30, i.e., the flow areas of openings 32, the level of NOX emissions can be changed. For this purpose, and as illustrated in FIGS. 4A, 4B and 4C, a set of dilution sleeves 34, 36, 38 are provided, each sleeve having a central opening of different diameter and hence different cross-sectional area. As illustrated, central openings 40, 42, 44 of sleeves 34, 36, 38, respectively, have different areas and, consequently, when used in the combustor, have the effect of increasing or decreasing the level of emissions. It will be appreciated that while only three flow sleeves having central openings of different areas are illustrated in FIGS. 4A, 4B and 4C, any number of flow sleeves 30 with different incremental sizes of the central openings 32 can be provided. Alternatively, a single set of flow sleeves are provided with the initially installed turbine. Those sleeves can be removed from the turbine as set forth herein, machined to provide the desired flow area and reinstalled into the turbine in accordance with the present invention.

To enable external access to the dilution sleeves to mechanically adjust the dilution air flow into the combustion chamber, each opening 26 through the flow sleeve 14 is provided with a collar 50 secured to sleeve 14. The collar 50 forms a seat for receiving the flange 54 of the dilution sleeve 30, it being appreciated that as illustrated, the cylindrical dilution sleeve 30 extends from flange 54 through openings 26 and 28 in the flow sleeve 14 and combustion liner 16, respectively, for delivering dilution air to the combustion chamber. To retain the sleeve 30 in the radially aligned openings 26 and 28, a cylindrical boss or flange 56 is provided on the outer casing 12 about an access port or opening 58. The opening 58 lies in radial alignment with the openings 26 and 28. The cylindrical boss 56 terminates at an outer annular end face in bolt holes to receive bolts 60 for securing a cover 62 to the boss 56. An element 64, such as a helical coil spring, extends between the outer casing 12, and particularly between the cover 62 and the flange 54 of each dilution sleeve 32 to maintain the sleeve seated on collar 50 and extending into the aligned openings 26 and 28. It will be appreciated that a pair of dilution sleeves, aligned openings, covers, seals and springs may be provided as illustrated in FIG. 2 at circumferentially spaced locations about the combustor, each identical to the other.

To change over from one set of dilution sleeves having a predetermined flow area to another set of dilution sleeves having a different flow area, it will be appreciated that the covers 62 may be removed by unthreading the bolts 60 from the boss 56. The springs 64 and sleeves 30 are therefore accessible externally of the combustor and are removed. Thus, the removed sleeves can be replaced by sleeves having the same outside diameters but having appropriately sized openings 32. Alternatively, the removed sleeves 30 can be machined to provide openings of different cross-sectional area or their openings can be reduced in size by inserting and welding a further sleeve within the dilution sleeve. With the sleeves having the appropriate sized dilution flow openings installed and seated on collars 50, the covers 62 and springs 64 are then reapplied to the outer casing with the springs maintaining the sleeve in position on collars 50. It will be appreciated that the compressor discharge air flowing in the annular passage 24 flows between the collars 50 and bosses 56 past the dilution sleeve flanges 54 and through the openings 32 of the sleeves 30 into the combustion chamber.

Upon initial installation of the gas turbine, the NOX emissions are measured. If the emissions are out of compliance with predetermined required emission levels, dilution sleeves having central openings with different cross-sectional areas are substituted for the dilution sleeves provided initially with the gas turbine or the initially provided dilution sleeves are modified, e.g., by machining, to provide dilution sleeves having central openings of appropriate area. If the deviation between the measured level of NOX emissions renders the turbine out of compliance, the desired change in dilution hole effective area can be calculated and a new dilution hole area determined.

Figure 3:
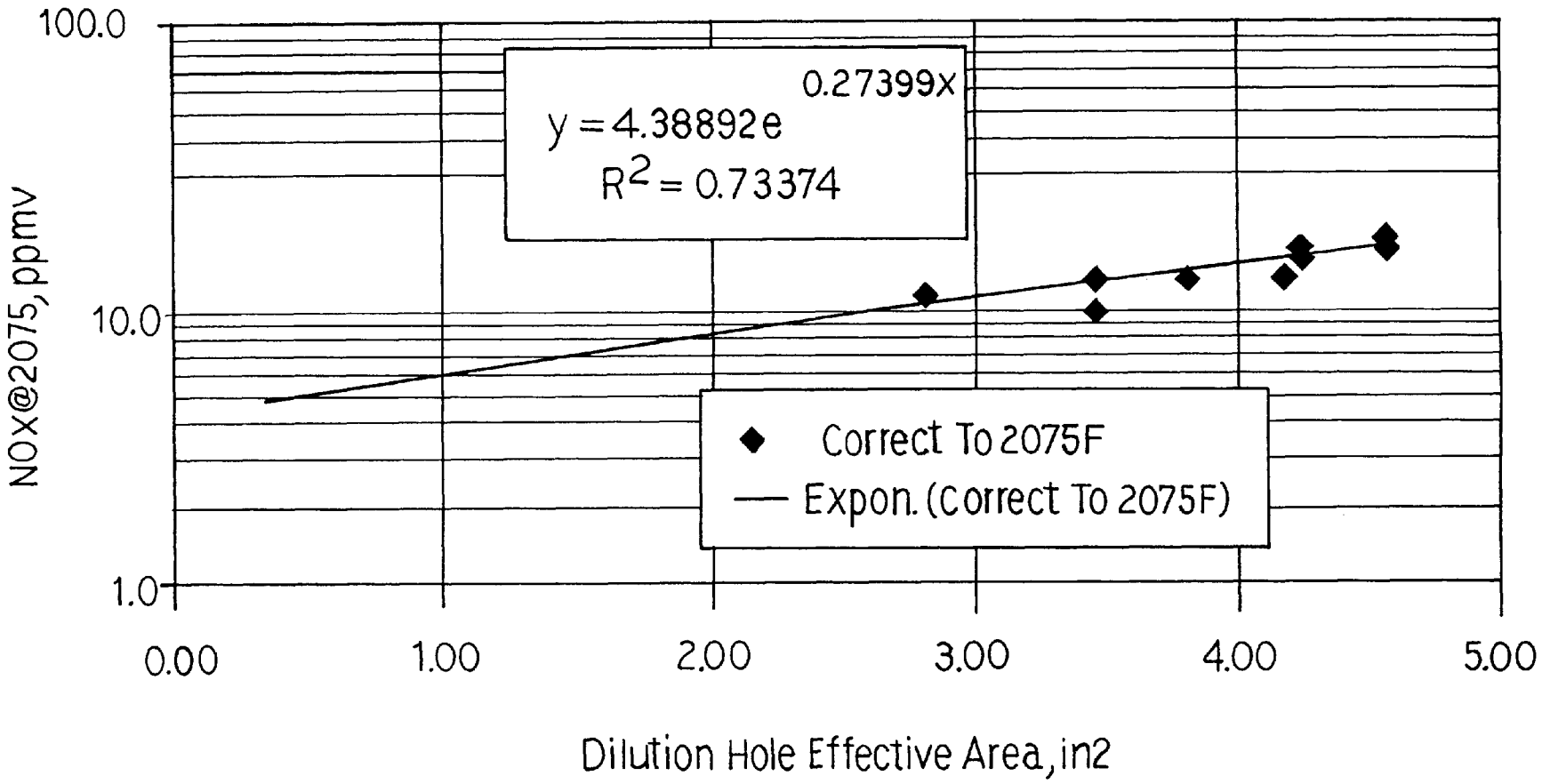
FIG. 3 is a graph of the NOX emissions versus dilution hole effective area by which the required hole area for NOX emissions in compliance can be determined.

A graph, typical to the graph illustrated in FIG. 3, may also be used to determine the desired change in dilution hole effective area and, consequently, the required dilution hole diameter whereby the extant dilution sleeves can be replaced by properly sized dilution sleeves or modified to obtain the desired dilution flow area. Through calculation or by employing the chart, the change in area of the dilution flow sleeve central openings from the flow area of the initially installed dilution sleeves to flow areas required to obtain a desired emission level can be ascertained. The chart is a plot of NOX emissions for a Frame 6B (by General Electric Power Systems of Schenectady, N.Y.) heavy duty gas turbine fired at 2,075° F. in parts per million versus dilution hole effective area in square inches, e.g., the chart being corrected for the firing temperature of 2,075° F.

Using the equation given on the chart, for a given measured NOX emission, the dilution hole effective area can be calculated to achieve a desired level of emissions. For example, the log of the measured NOX divided by dilution hole effective area=0.27399. This implies that for a 10% increase in NOX emission levels, the increase in dilution hole effective area would be log In (1.10) divided by 0.27399=0.3479 square inches. Consequently, with this calculated or graphically obtained increase in dilution hole effective area, the dilution hole area necessary to bring the NOX emissions level into compliance is obtained. Similar graphs corrected using calculations or experimental data can be applied to larger or smaller gas turbine combustion systems.

A set of sleeves having a dilution hole area approximating or corresponding to the desired hole area can then be selected from dilution sleeve sets of different diameters, for example, those illustrated in FIGS. 4A–4C and installed to provide dilution sleeves having desired flow area. Typically, where sets of dilution sleeves are provided, the desired change in area from the extant dilution sleeve will not correspond exactly with the increments in cross-sectional hole areas of the sets of dilution sleeves. Accordingly, given the change in effective area necessary, a set of dilution sleeves that approximates the desired effective area, whether on the high or low side of the calculated change in area, may be used. Alternatively, the extant dilution sleeves may be removed and machined or material added as necessary to achieve the desired flow area. Once the dilution flow sleeves having the desired flow areas are identified, they are installed as previously discussed.

Figure 5:
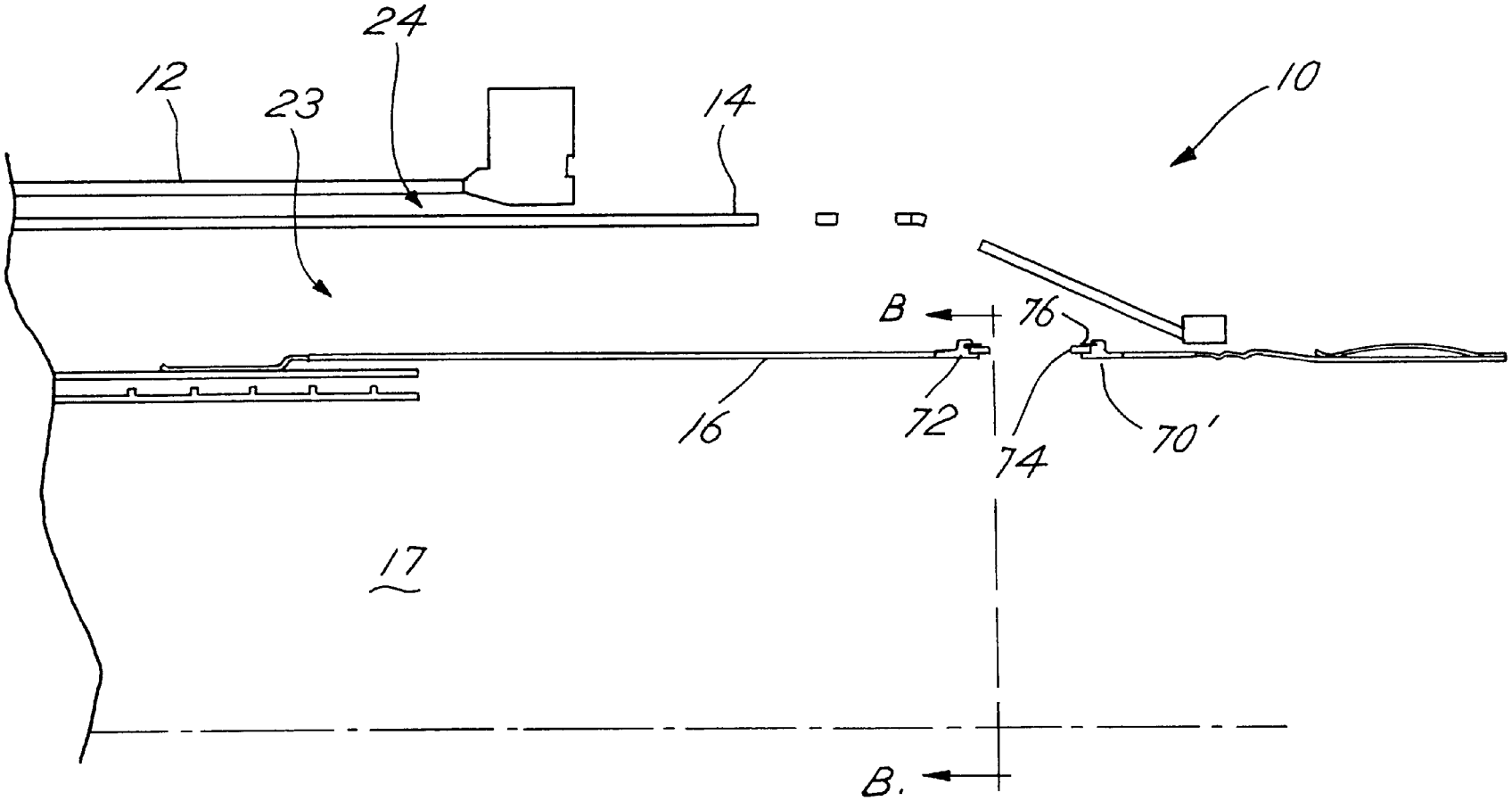
FIG. 5 is a fragmentary cross-sectional view of a part of a combustor for a gas turbine in accordance with an alternative embodiment of the present invention.
Figure 8:
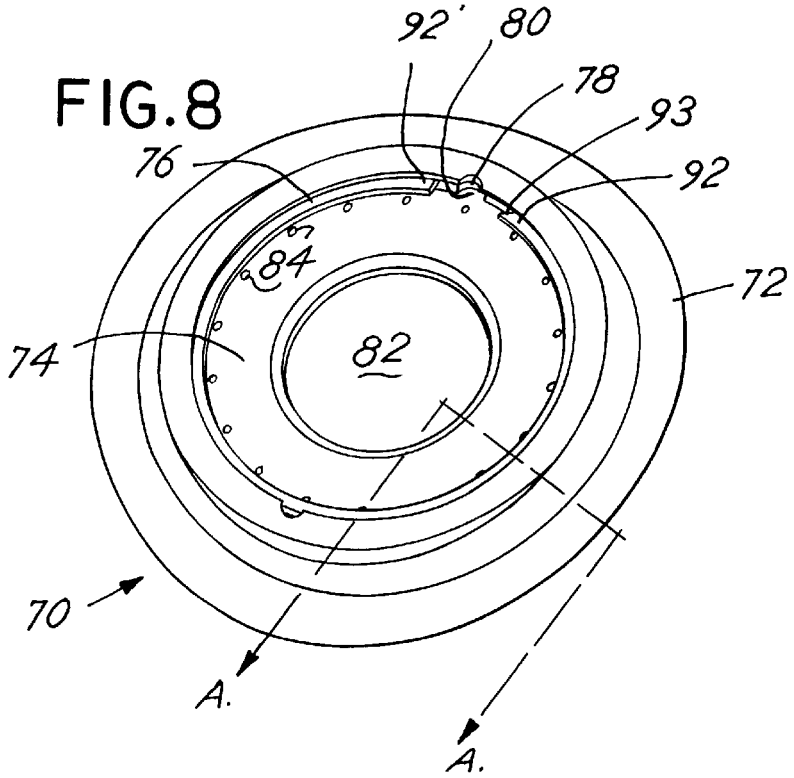
FIG. 8 is a top perspective view of the assembled embodiment shown in FIG. 6.
Figure 9:
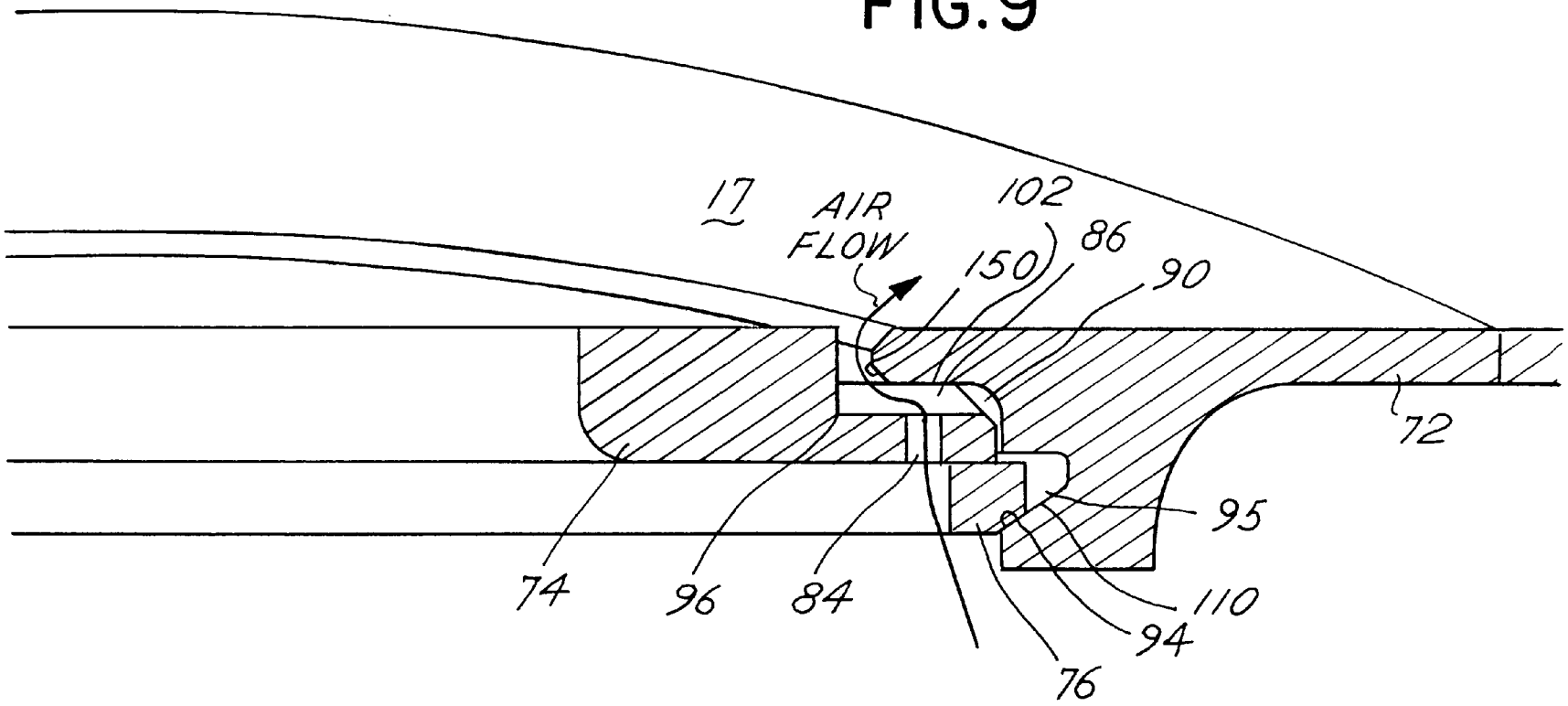
FIG. 9 is a cut away view of the assembled embodiment shown in FIG. 8, taken along line A—A.
Figure 10:
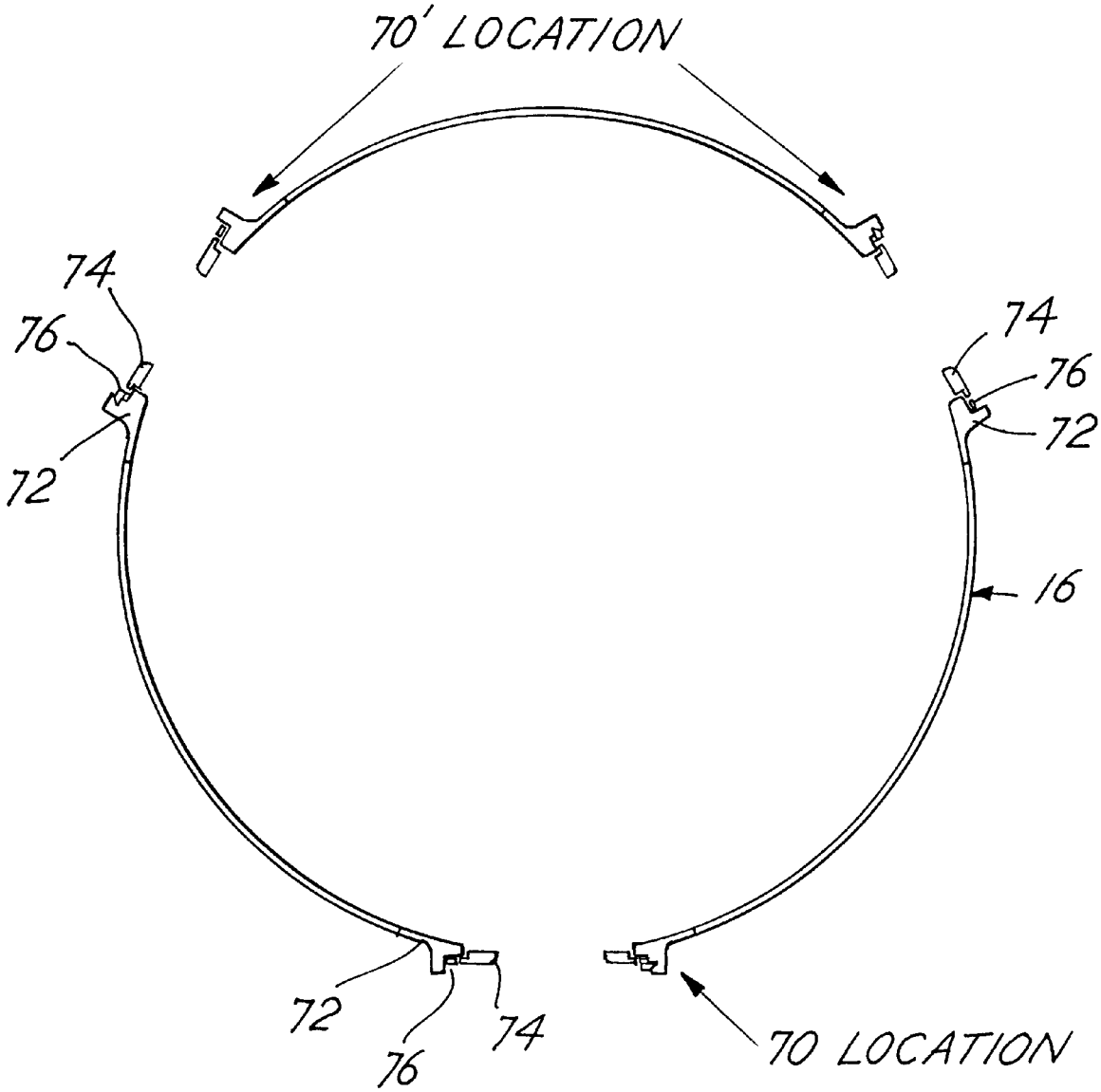
FIG. 10 is a rotated (60 degrees counter clockwise) cross-sectional view taken along line B—B in FIG. 5.

FIGS. 5 through 10 illustrate an alternative embodiment in accordance with the present invention. As shown in FIG. 5, combustor 10 has an outer casing 12, flow sleeve 14, and flow liner 16. Liner 16 has at least one combustor orifice assembly 70. FIG. 10 is the rotated (60 degrees counter clockwise) cross-sectional view taken along line B—B in FIG. 5. In the embodiment shown in FIG. 10, there is one combustor orifice assembly 70 at the bottom of combustor 10, and two combustor orifice assemblies 70'. The combustor orifice assemblies 70 and 70' may be equally spaced from one another around the periphery of liner 16. The combustor orifice assembly 70 at the bottom of combustor 10 is the inboard orifice assembly (since it the orifice assembly closest to the turbine engine (not shown)) and the orifice assemblies 70' in the upper portion of combustor 10 are the outboard orifice assemblies as shown in FIG. 11.

Figure 6:
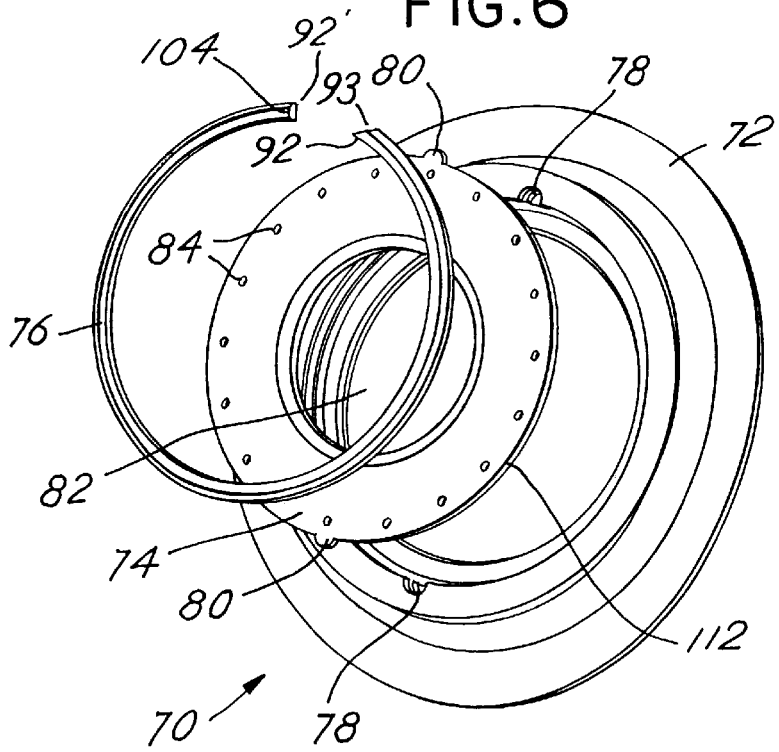
FIG. 6 is an exploded view of the embodiment shown in FIG. 5.

FIG. 6 is an exploded view of an embodiment of the present invention. More specifically, combustor orifice assembly 70 has a boss 72, an orifice plate 74, and a retaining ring 76. Combustor orifice assemblies 70' can have a similar construction. Boss 72 may have an anti-rotation slot 78 (two (2) anti-rotation slots 78 are shown in FIG. 6) adapted to receive an anti-rotation tab 80 of the orifice plate 74 shown in FIG. 7. The combination of anti-rotation tab 80, when positioned within anti-rotation slot 78, prevents rotation of orifice plate 74.

When two anti-rotation slots 78 and corresponding anti-rotation tabs 80 are used in an orifice assembly 70, the slots 78 can by separated by a first fixed angle 98, and the tabs 80 can be separated by the same first fixed angle. Further, two anti-rotation slots 78 and corresponding anti-rotation tabs 80 can be used in orifice assembly 70', and these slots 78 can be separated by a second fixed angle 100, and these tabs 80 can be separated by the same second fixed angle 100, where the second fixed angle 100 is different from the first fixed angle 98 between the slots and tabs in orifice assembly 70. Thus, the anti-rotation slots 78 and anti-rotation tabs 80 can serve an additional function of ensuring that an orifice plate 74 for an inboard orifice assembly 70 has tabs having a first fixed angle 98 that corresponds to the same first fixed angle 98 of separation between slots within a boss 72 of an inboard orifice assembly 70, and not receive an orifice plate 74 for an outboard orifice assembly 70'.

Similarly, the anti-rotation slots 78 and anti-rotation tabs 80 can serve an additional function of ensuring that an orifice plate 74 for an outboard orifice assembly 70' has tabs having a second fixed angle 100 that corresponds to the same second fixed angle 100 of separation between slots within a boss 72 of an outboard orifice assembly 70', and not receive an orifice plate 74 for an inboard orifice assembly 70.

Orifice plate 74 defines an orifice 82 having the correct size to meet emission requirements. The smaller that orifice 82 is, the cooler the flame and the less NOX emissions. Orifice plate 74 can also define holes 84 each surrounded by a corresponding channel 86, both of which are located around the periphery of a bottom surface 88 the orifice plate 74. As shown, holes 84 are each much smaller than orifice 82. Bottom surface 88 of orifice plate 74 is adapted to be received by orifice plate groove 90 of boss 72.

Retaining ring 76 has two ends 92 and 92', either or both of which can have a chamfer 93. In FIGS. 6 and 8, end 92 has a chamfer 93. Chamfer 93 permits easy release of ring 76 from boss 72. Retaining ring 76 may have an angled surface 94 that fits within the retaining ring groove 95 of boss 72.

Figure 7A:
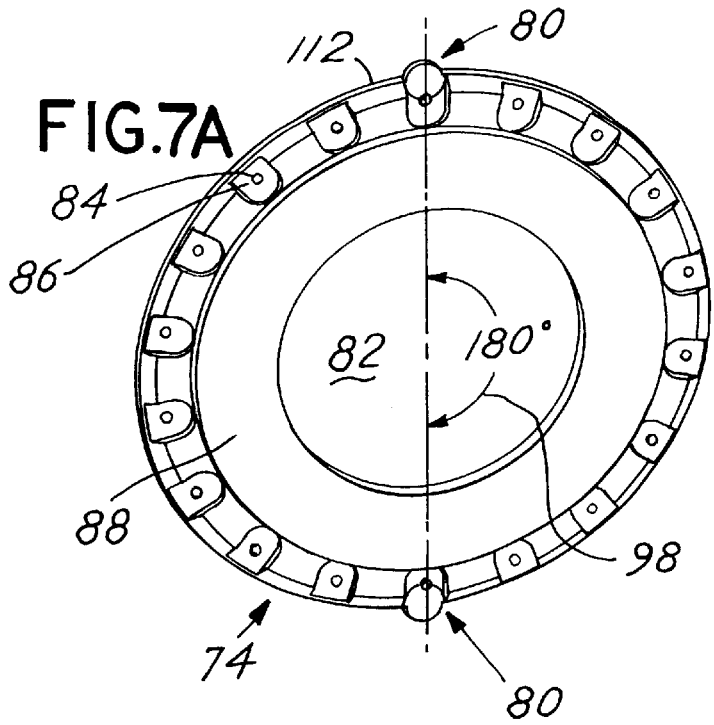
FIG. 7A is a bottom view of the combustor orifice assembly shown in FIG. 6, having a first fixed angle of 180 degrees between anti-rotation tabs 80.
Figure 7B:
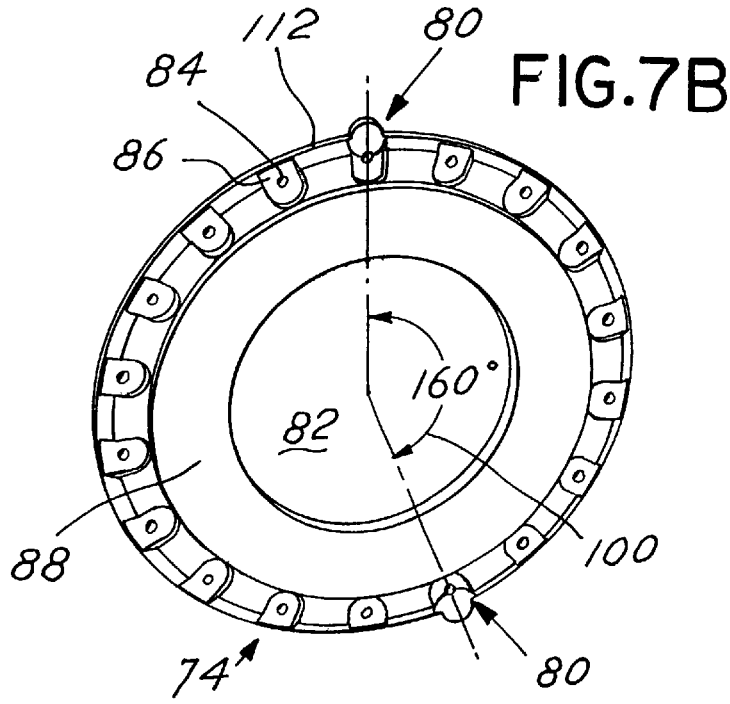
FIG. 7B is a bottom view of the combustor orifice assembly shown in FIG. 6, having a second fixed angle of 160 degrees between anti-rotation tabs 80.

FIG. 7 is a bottom view of the orifice plate 74 shown in FIG. 6. Orifice plate 74 may have at least one anti-rotation tab 80.

FIG. 8 is a top perspective view of the assembled embodiment shown in FIG. 6.

FIG. 9 is a cut away view of the assembled embodiment shown in FIG. 8, taken along line A—A. Holes 84 permit cooling air flow through orifice plate 74 and around orifice plate step 96 to hot gas flow path 17 of the combustor 10. Holes 84 permit cooling so that the components do not get too hot. Specifically, the temperature of both boss 72 and orifice plate 74 is decreased to reduce cracking, which is a function of thermal strain and temperature.

The design of the present invention allows for all three dilution hole sizes to be changed on site during a combustor retune, instead of being resized at a service shop. During a retune in accordance with this alternative embodiment, the new orifice plates with the required dilution orifices are substituted for the old orifice plates right on site. The retaining rings 76 permit quick and easy replacement of incorrectly sized orifices with correctly sized orifices.

Boss 72 may be welded to the liner 16 and have the following features:

1. A planer interface 102 and orifice plate groove 90 corresponding to and adapted to receive orifice plate 74 for simple and symmetric orifice geometry.
2. At least one anti-rotation slot 78 to prevent orifice plate 74 from rotating and/or vibrating. Rotation and vibration can lead to wear between the orifice plate 74 and boss 72.
3. As described above, two anti-rotation slots 78 defined by a boss 72 can be separated by either a first fixed angle 98 for inboard orifice assembly 70 or a second fixed angle 100 (different from the first fixed angle) for outboard orifice assembly 70' to ensure that the correct orifice plates are inserted in the inboard orifice assembly 70 and the outboard orifice assemblies 70', respectively. By way of example, the first fixed angle 98 can be 180 degrees, and the second fixed angle 100 can be 160 degrees. Thus, the bosses 72 for the outboard orifice assemblies 70' can have two slots 78 separated by a second fixed angle to receive only outboard orifice plates and not receive an inboard orifice plate. Similarly, boss 72 for the inboard orifice assembly 70 can have slots 78 separated by a first fixed angle 98 to receive only the anti-rotation tabs 80 of an inboard orifice plate, and not receive the anti-rotation tabs 80 of an outboard orifice plate. This ensures correct orifice installation. The inboard orifice assembly 70 can have an orifice that is about twice as large as the orifice for the orifice assemblies 70' to provide a correct combustor exit temperature profile.
4. Retaining ring groove 95 has an angled surface 110 to match retaining ring angled surface 94.

Orifice plate 74 may have the following features:

1. Peripheral surface 112 can have at least one anti-rotation tab 80. As noted above, an inboard orifice assembly 70 can have two anti-rotation tabs 80 having a first fixed angle 98 to ensure that only an inboard orifice 74 is inserted into inboard orifice assembly 70. Similarly, an outboard orifice assembly 70' can have two anti-rotation tabs 80 having a second fixed angle 100 to ensure that only an outboard orifice 74 is inserted into outboard orifice assembly 70'.
2. Cooling holes 84 and channels 86 to increase durability of boss 72 and orifice plate 74.
3. Step 96 permits cooling flow around boss surface 150 to increase boss durability.
4. Simple and symmetric design.

Retaining ring 76 may have the following features:

1. Angled surface 94 preloads the orifice plate 74 to prevent wear.
2. Angled surface 94 is sized to prevent jamming and resulting boss deformation.
3. An asymmetric cross-section 104 to prevent improper installation within boss 72. By having an asymmetric cross-section 104, retaining ring 76 will only seat correctly within retaining ring groove 95 of boss 72 when installed in the correct orientation.

When the orifice plate 74 needs to be replaced from combustor 10, for example, to install a different sized orifice 82, the following steps can be taken. First, the retaining ring 76 can be easily removed from combustor 10 in any suitable manner. Retaining ring 76 can be removed by moving ends 92 together by hand or using a suitable tool, and freeing the angled surface 94 of retaining ring 76 from the angled surface 110 of boss 72. Once the retaining ring 76 is removed, orifice plate 74 can be easily removed from boss 72. A new orifice plate 74 having a different sized orifice 82 can be inserted in orifice plate groove 90 of boss 72. Once the new orifice plate 74 is installed, the retaining ring 76 can be installed by moving the ends 92 together by hand or using a suitable tool, placing the angled surface 94 of retaining ring 76 within the angled surface 110 of boss 72, and then allowing the angle surface 94 to spring against surface 110 of boss 72.

While the invention has been described in connection with what is presently considered to be the most practical embodiments, it is to be understood that the invention is not to be limited to the disclosed embodiments, but on the contrary, is intended to cover various modifications and equivalent arrangements included within the spirit and scope of the appended claims.

What is claimed is:

1. A combustor having a combustion liner and at least one combustor orifice assembly, the combustor orifice assembly comprising:

a boss having an inside periphery and defining an opening, the boss located on the combustion liner;

an orifice plate that defines an orifice, the orifice plate having a bottom surface that is adapted to be received by the inside periphery of the boss, the orifice plate separate from the combustion liner; and a retaining ring, whereby the orifice plate is retained between the retaining ring and the boss, wherein the boss has a retaining ring adapted to receive the retaining ring and wherein the retaining ring groove has an angled surface adapted to receive an angled surface of the retaining ring.

2. The combustor of claim 1 having three combustor orifice assemblies, wherein one orifice assembly is at the bottom of the combustor.

3. The combustor of claim 2 wherein the three combustor orifice assemblies are equally spaced apart from each other around the outer periphery of the linear and one orifice assembly at the bottom of the combustor.

4. The combustor of claim 1 wherein the boss has at least one anti-rotation slot adapted to receive at least one anti-rotation tab of the orifice plate.

5. The combustor of claim 2 wherein the orifice assembly at the bottom of the combustor comprises a boss having at least two anti-rotation slots separated by a first fixed angle and an orifice plate having at least two anti-rotation tabs corresponding to the anti-rotation slots of the boss and separated by the same first fixed angle, and the other two orifice assemblies each comprises a boss having at least two anti-rotation slots separated by a second fixed angle and an orifice plate having at least two anti-rotation tabs corresponding to the anti-rotation slots of the boss and separated by the same second fixed angle, wherein the first fixed angle and the second fixed angle are different.

6. The combustor of claim 3 wherein the orifice assembly at the bottom of the combustor comprises a boss having at least two anti-rotation slots separated by a first fixed angle and an orifice plate having at least two anti-rotation tabs corresponding to the anti-rotation slots of the boss and separated by the same first fixed angle, and the other two orifice assemblies each comprises a boss having at least two anti-rotation slots separated by a second fixed angle and an orifice plate having at least two anti-rotation tabs corresponding to the anti-rotation slots of the boss and separated by the same second fixed angle, wherein the first fixed angle and the second fixed angle are different.

7. The combustor of claim 1 wherein the orifice plate defines cooling holes and a channel corresponding to each cooling hole, the cooling holes and corresponding channels located around the outer periphery of the bottom surface of the orifice plate.

8. The combustor of claim 1 wherein the orifice plate has a step around the outer periphery of a bottom surface of the orifice plate, the step adapted to be received within an orifice plate groove defined by the boss.

9. The combustor of claim 1 wherein the retaining ring has two ends that are spring loaded to expand away from each other and thus press the retaining ring against the boss when installed within the retaining ring groove of the boss so as to retain the retaining ring within the boss.

10. The combustor of claim 2 wherein the retaining ring has an asymmetric cross-section to allow the retaining ring to be received by the retaining ring groove of the boss.

11. The combustor of claim 2, wherein the orifice of the orifice assembly at the bottom of combustor is larger than each of the other two orifices of the other two orifice assemblies.

12. The combustor of claim 3, wherein the orifice of the orifice assembly at the bottom of combustor is larger than each of the other two orifices of the other two orifices assemblies.

13. The combustor of claim 2, wherein the orifice of the orifice assembly at the bottom of combustor is about twice as large as each of the other two orifices of the other two orifice assemblies.

14. The combustor of claim 3, wherein the orifice of the orifice assembly at the bottom of combustor is about twice as large as each of the other two orifice assemblies.

15. A combustor having a combustion liner and at least one combustor orifice assembly, the combustor orifice assembly comprising:

a boss having an inside periphery and defining an opening, the boss located on the combustion liner;

an orifice plate that defines an orifice, the orifice plate having a bottom surface that is adapted to be received by the inside periphery of the boss, the orifice plate separate from the combustion liner;

a retaining ring, whereby the orifice plate is retained between the retaining ring and the boss, and wherein the orifice plate defines cooling holes and a channel corresponding to each cooling hole, the cooling holes and corresponding channels located around the outer periphery of the bottom surface of the orifice plate.

16. The combustor of claim 15, wherein the boss has a retaining ring groove adapted to receive the retaining ring.

17. The combustor of claim 15 having three combustor orifice assemblies, wherein one orifice assembly is at the bottom of the combustor.

18. The combustor of claim 17 wherein the three combustor orifice assemblies are equally spaced apart from each other around the periphery of the liner and one orifice assembly at the bottom of the combustor.

19. The combustor of claim 15 wherein the boss as at lest one anti-rotation slot adapted to receive at least one anti-rotation tab of the orifice plate.

20. The combustor of claim 17 wherein the orifice assembly at the bottom of the combustor comprises a boss having at least two anti-rotation slots separated by a first fixed angle and an orifice plate having at least two anti-rotation tabs corresponding to the anti-rotation slots of the boss and separated by the same first fixed angle, and the other two orifice assemblies each comprises a boss having at least two anti-rotation slots separated by a second fixed angle and an orifice plate having at least two anti-rotation tabs corresponding to the anti-rotation slots of the boss and separated by the same second fixed angle, wherein the first fixed angle and the second fixed angle are different.

21. The combustor of claim 18 wherein the orifice assembly at the bottom of the combustor comprises a boss having at least two anti-rotation slots separated by a first fixed angle and an orifice plate having at least two anti-rotation tabs corresponding to the anti-rotation slots of the boss and separated by the same first fixed angle, and the other two orifice assemblies each comprises a boss having at least two anti-rotation slots separated by a second fixed angle and an orifice plate having at least two anti-rotation tabs corresponding to the anti-rotation slots of the boss and separated by the same second fixed angle, wherein the first fixed angle and the second fixed angle are different.

22. The combustor of claim 15 wherein the orifice plate has a step around the outer periphery of a bottom surface of the orifice plate, the step adapted to be received within an orifice plate groove defined by the boss.

23. The combustor of claim 16 wherein the retaining ring has two ends that are spring loaded to expand away from each other and thus press the retaining ring against the boss when installed within the retaining ring groove of the boss so as to retain the retaining ring within the boss.

24. The combustor of claim 16, wherein the retaining ring has an asymmetric cross-section to allow the retaining ring to be received by the retaining ring groove of the boss.

25. The combustor of claim 17, wherein the orifice of the orifice assembly at the bottom of the combustor is larger than each of the other two orifices of the other two orifice assemblies.

26. The combustor of claim 18, wherein the orifice of the orifice assembly at the bottom of the combustor is larger than each of the other two orifices of the other two orifice assemblies.

27. The combustor of claim 17, wherein the orifice of the orifice assembly at the bottom of the combustor is about twice as large as each of the other two orifices of the other two orifice assemblies.

28. The combustor of claim 18, wherein the orifice of the orifice assembly at the bottom of the combustor is about twice as large as each of the other two orifices of the other two orifice assemblies.

* * * * *

UNITED STATES PATENT AND TRADEMARK OFFICE

CERTIFICATE OF CORRECTION

PATENT NO. : 6,499,993 B2 
DATED : December 31, 2003
INVENTOR(S) : Charles Evan Steber et al.

It is certified that error appears in the above-identified patent and that said Letters Patent is hereby corrected as shown below:

Title page,
Item [56], References Cited, U.S. PATENT DOCUMENTS "1/1993" has been replaced with -- 8/1993 --.

Signed and Sealed this

Third Day of June, 2003

JAMES E. ROGAN
*Director of the United States Patent and Trademark Office*